United States Patent [19]

Ratcliff, Jr.

[11] 4,311,284

[45] Jan. 19, 1982

[54] DEVICE FOR FRACTURING MATERIAL

[75] Inventor: Edward H. Ratcliff, Jr., Millersburg, Ky.

[73] Assignee: The W. R. Stamler Corporation, Millersburg, Ky.

[21] Appl. No.: 112,810

[22] Filed: Feb. 8, 1980

[51] Int. Cl.[3] ..... B02C 13/28

[52] U.S. Cl. ..... 241/191; 241/295

[58] Field of Search ..... 299/89; 241/189 R, 191, 241/294, 295

[56] References Cited

U.S. PATENT DOCUMENTS 39,835 9/1863 Reece ..... 241/295

2,585,943 2/1952 Kessler ..... 241/294

3,146,961 9/1964 Putman, Jr. ..... 241/191

3,817,305 6/1974 Gibbs ..... 241/191 X

*Primary Examiner*—Howard N. Goldberg

*Attorney, Agent, or Firm*—Frank C. Leach, Jr.

[57] ABSTRACT

A plurality of rings is mounted on a shaft for rotation therewith with each ring having a plurality of equally angularly spaced bits mounted thereon to fracture material. Each of the rings has an insert mounted in a recess in its periphery between each adjacent pair of the bits. The insert has an angled edge to fracture, rather than crush, the material between the bits as the rings are rotated.

18 Claims, 5 Drawing Figures

DEVICE FOR FRACTURING MATERIAL

When breaking aggregate material such as rock, for example, it is desired to break up the rock into particles of smaller size without having the particles too small. Thus, it is desired to fracture the rock without causing crushing thereof.

One previously suggested device for fracturing rock has had a plurality of rings mounted on a rotating shaft for rotation therewith. Each of the rings has a plurality of equally angularly spaced cut out portions along its circumference with a bit holder mounted in each of the cut out portions. Each of the bit holders has a bit supported therein for fracturing the rock as each of the bits is moved into engagement with the rock, which is advanced past and beneath the rotating rings having the bits by a conveyor, for example.

While the bits fracture rock that they engage during rotation of the rings, fractured rocks of certain sizes may be engaged by the flat, arcuate surface forming the circumference of the ring between adjacent pairs of the cut out portions. If this occurs, the rock is crushed, rather than being fractured; this produces particles of rock of smaller size than desired.

The crushing of the material by the circumference of the ring between the adjacent bits requires an increased horsepower. Thus, this crushing not only produces particles of a smaller size than desired but also requires an increased horsepower for rotating the rings.

Additionally, particles of rock can be caught or stuck between the advancing portion of a bit and the adjacent flat surface on the circumference of the ring. This can result in shearing of the bit.

The device of the present invention satisfactorily solves the foregoing problems through forming a recess in a flat surface, which is preferably straight, of the periphery of a ring between the cut out portions in the ring periphery for each adjacent pair of the bit holders. Each recess receives an insert having an angled edge at its outermost surface to cause fracturing, rather than crushing, of the rock between the adjacent pair of the bits.

As a result, the rock is fractured rather than crushed by the device of the present invention. Additionally, because of fracturing, rather than crushing, the rock, the required horsepower is reduced in comparison with the prior fracturing device.

An object of this invention is to provide an improved device for fracturing aggregate type of material.

Another object of this invention is to provide a material fracturing device that substantially eliminates crushing of material.

Other objects of this invention will be readily perceived from the following description, claims, and drawings.

This invention relates to a device for fracturing an aggregate type of material including a ring rotatable relative to the material to be fractured. The ring has a plurality of angularly spaced bits mounted thereon around its periphery for contacting the material when the ring is rotated relative to the material to fracture the material. The ring has a bit holder for each of the bits with each of the bit holders being disposed in a cut out portion in the periphery of the ring. The ring has fracturing means between each adjacent pair of the bits to aid in fracturing the material during rotation of the ring.

This invention also relates to a device for fracturing an aggregate type of material including a rotating shaft and a plurality of rings mounted on the shaft for rotation therewith relative to the material to be fractured. The rings are spaced from each other axially along the shaft by suitable means. Each of the rings has a plurality of angularly spaced bits mounted thereon around its periphery for contacting the material when the rings are rotated with the shaft relative to the material to fracture the material. Each of the rings has a bit holder for each of the bits with each of the bit holders being disposed in a cut out portion in the periphery of the ring. Each of the rings has fracturing means between each adjacent pair of the bits to aid in fracturing the material during rotation of the shaft.

The attached drawings illustrate a preferred embodiment of the invention, in which.

Figure 1:
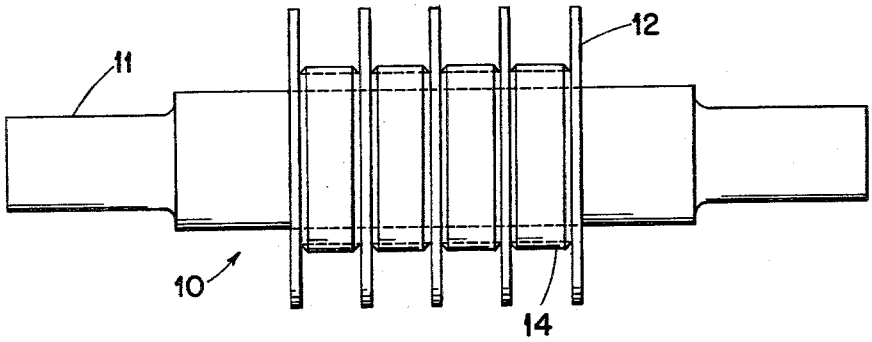
FIG. 1 is an elevational view of a material fracturing device of the present invention without the bits, the bit holders, and the inserts being shown on the rings.

Referring to the drawings and particularly FIG. 1, there is shown a material fracturing device 10 of the present invention. The device 10 includes a shaft 11, which is rotated by a suitable drive means (not shown) with the shaft 11 being disposed with its axis horizontal.

Each of a plurality of rings 12 is mounted on the shaft 11 by suitable means such as welding, for example. The rings 12 are spaced axially along the shaft 11 an equal distance from each other by tubular spacers 14, which are secured to the rings 12 by suitable means such as welding, for example.

Figure 2:
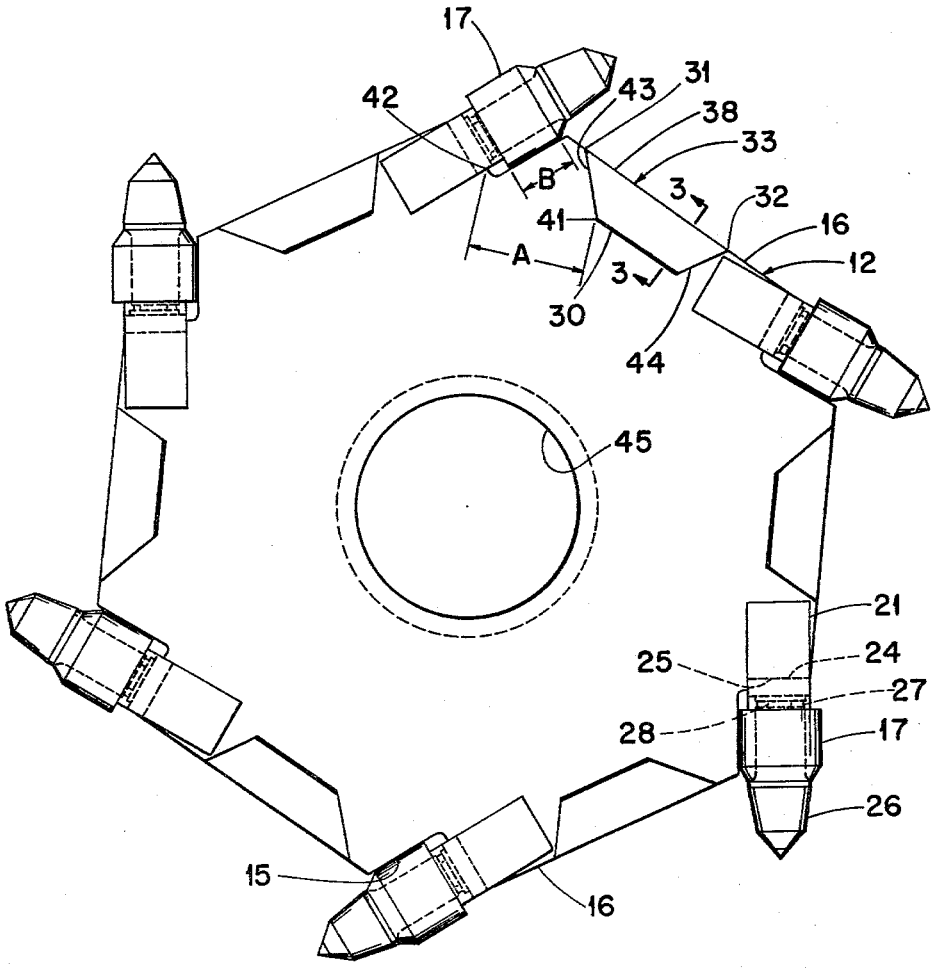
FIG. 2 is a front elevational view of one of the rings of the material fracturing device of FIG. 1.

As shown in FIG. 2, each of the rings 12 has a plurality (six shown) of cut out portions 15 formed in its periphery and preferably equally angularly spaced. Each of the rings 12 has a substantially flat surface 16, which is preferably straight, on its periphery extending between each adjacent pair of the cut out portions 15.

Figure 5:
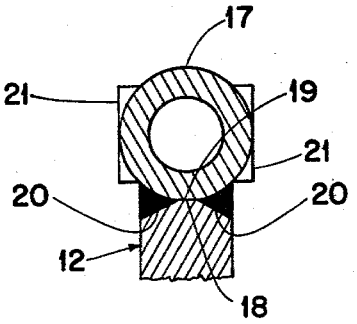
FIG. 5 is a sectional view of a portion of the ring of FIG. 2 including one of the bit holders without the bit mounted therein and taken along line 5—5 of FIG. 4.

Each of the cut out portions 15 has a bit holder 17 welded thereto. As shown in FIG. 5, the bit holder 17 has an annular cross section with a slight flat surface 18 on its circumference cooperating with a flat surface 19 of the cut out portion 15 to enable welding material to be disposed between the bit holder 17 and bevelled edges 20 of the ring 12 as shown in FIG. 5.

Figure 4:
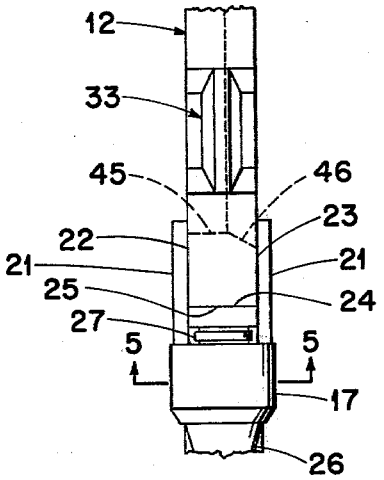
FIG. 4 is a fragmentary end elevational view of a portion of the ring of FIG. 2.

Each of the bit holders 17 has a pair of back-up plates 21 secured thereto by suitable means such as welding, for example. Each of the back-up plates 21 also is secured to one of two opposite side surfaces or walls 22 (see FIG. 4) and 23 of the ring 12 by suitable means such as welding, for example.

An impact plate 24 is secured to the ring 12 in each of the cut out portions 15 against a surface 25 of the cut out portion 15 of the ring 12 by suitable means such as welding, for example. The impact plate 24 absorbs part of the impact when a bit 26, which is mounted in the bit holder 17, engages the material to be fractured during rotation of the ring 12. The ring 12 rotates clockwise in FIG. 2 to cause fracturing of the material by each of the bits 26 contacting the material on a conveyor (not shown), for example, moving from right to left in FIG. 2.

The bit 26 is retained within the holder 17 by any suitable means. For example, a ring 27 may be disposed within a groove 28 (see FIG. 2) in the bit 26 and engage the back of the bit holder 17 to limit outward movement of the bit 26.

Each of the substantially flat surfaces 16 of the ring 12 has a recess 30 formed therein. Each of the recesses 30 is formed so that its trailing edge 31 is closer to the adjacent bit holder 17 rearward of the trailing edge 31 than its leading edge 32 is to the adjacent bit holder 17 forward of the leading edge 32 of the recess 30. Each of the recesses 30 has an insert 33 retained therein by suitable securing means such as welding, for example.

Figure 3:
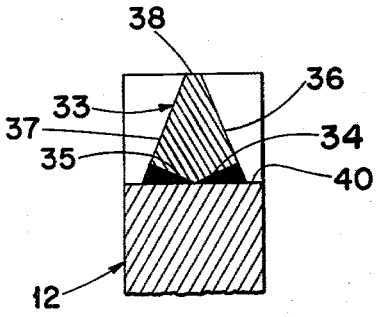
FIG. 3 is a sectional view of a portion of the ring of FIG. 2 including one of the inserts and taken along line 3—3 of FIG. 2.

As shown in FIG. 3, the insert 33 has a pair of angled bottom walls 34 and 35, a pair of angled side walls 36 and 37, and a top edge or wall 38 at the junction of the side walls 36 and 37. The edge 38 forms the outermost surface of the insert 33 and is an angled edge because of the angled side walls 36 and 37.

The angled or bevelled bottom walls 34 and 35 enable welding material to be between the walls 34 and 35 and a bottom surface 40 of the recess 30 in the ring 12. The edge 38 of the insert 33 forms a continuation of the substantially flat surface 16 of the ring 12 as shown in FIG. 2.

The insert 33 is preferably a steel bar sold by Ford Steel Company under the trade name Mangalloy Steel. It has a Brinell hardness of 200 and a tensile strength of 150,000 p.s.i. The composition of the material of the bar is 11 to 13½ percent manganese steel, 2½ to 3½ percent nickel steel, and the remainder a medium carbon steel. The insert 33 may be formed of any other suitable material capable of fracturing aggregate material.

To prevent any tearing out of the insert 33, a distance A, which is between a bottom, trailing edge 41 of the recess 30 and corner 42 of the cut out portion 15, must be greater than a distance B, which is the distance along the flat surface 19 (see FIG. 5) of the cut out portion 15 having the ring 12 of the holder 17 welded thereto. The distances A and B are shown in FIG. 2.

In the preferred embodiment, the recess 30 has its rear or trailing wall 43 at an angle of 45° to the substantially flat surface 16 of the ring 12 and its front or leading wall 44 at an angle of 60° to the substantially flat surface 16 of the ring 12. However, the angles could be the same, for example, as long as the distance A is greater than the distance B. It is preferred for the front wall 44 of the recess 30 to not interrupt the end surface 22 (see FIG. 4) or 23 so that the entire surface of one of the back-up plates 21 can engage therewith.

One end of the substantially flat surface 16 (see FIG. 2) terminates adjacent the bit holder 17. This enables the bit holder 17 to prevent aggregate material such as rock, for example, from engaging a blunt corner.

Each of the rings 12 has an opening 45 in its center to receive the shaft 11 (see FIG. 1). The opening 45 (see FIGS. 2 and 4) is circular from the side surface or wall 22 (see FIG. 4) inwardly for greater than half of the thickness of the ring 12. A bevel 46 is formed for the remainder of the distance to the end surface or wall 23 to enable welding of the ring 12 to the shaft 11 (see FIG. 1).

The device 10 is assembled by standing the shaft 11 on one end so that shaft 11 is in a vertical position. Then, one of the rings 12 is positioned over the shaft 11 with the bevel 46 (see FIG. 4) facing upwardly. The ring 12 (see FIG. 1) is then welded to the shaft 11 on both sides of the ring 12.

Then, one of the tubular spacers 14 is placed over the shaft 11 and in engagement with the ring 12, which has been welded to the shaft 11. Then, another of the rings 12 is positioned on the shaft 11 with the bevel 46 (see FIG. 4) facing upwardly and welded thereto. Next, one of the spacers 14 (see FIG. 1) is positioned on the shaft 11. This continues until the last of the rings 12 is welded to the shaft 11.

Then, the shaft 11 is disposed in a horizontal position. At this time, each of the spacers 14 is welded to the rings 12. Thus, the spacers 14 are secured only to the rings 12 and not to the shaft 11.

As shown in FIG. 1, there are five of the rings 12 on the shaft 11 with the rings 12 being identical. In the preferred embodiment, the bits 26 (see FIG. 2) are equally angularly spaced from each other about the periphery of each of the rings 12.

However, the bits 26 on each of the rings 12 are staggered relative to the bits 26 on the other of the rings 12. That is, if the ring 12 to the right in FIG. 1 is deemed to be the first ring and the ring 12 on the left in FIG. 1 is deemed to be the fifth ring with the rings 12 therebetween progressing numerically, then the bits 26 (see FIG. 2) on the third ring 12 (see FIG. 1) are staggered 12° relative to the bits 26 (see FIG. 2) on the first ring 12 (see FIG. 1), the bits 26 (see FIG. 2) on the fifth ring 12 (see FIG. 1) are staggered 24° with respect to the bits 26 (see FIG. 2) on the first ring 12 (see FIG. 1), the bits 26 (see FIG. 2) on the second ring 12 (see FIG. 1) are staggered 36° relative to the bits 26 (see FIG. 2) on the first ring 12 (see FIG. 1), and the bits 26 (see FIG. 2) on the fourth ring 12 (see FIG. 1) are staggered 48° with respect to the bits 26 (see FIG. 2) on the first ring 12 (see FIG. 1). Thus, one of the bits 26 (see FIG. 2) on one of the rings 12 (see FIG. 1) is striking the aggregate material during every 12° of rotation of the shaft 11. Of course, the bits 26 (see FIG. 2) are not necessarily striking the same aggregate material because the rings 12 (see FIG. 1) are spaced axially along the shaft 11.

While the bits 26 (see FIG. 2) are preferably equally angularly spaced from each other on each of the rings 12, it should be understood that such is not required for satisfactory operation. It is only necessary that there be sufficient space between each adjacent pair of bits 26 for one of the inserts 33, which would not have to be the same length but could have their lengths in accordance with the spacings between each adjacent pair of the bits 26.

While the bits 26 on each of the rings 12 are preferably staggered relative to the bits 26 on the other of the rings 12 on the shaft 11 (see FIG. 1), it should be understood that such is not necessary for satisfactory operation. However, the staggered arrangement produces a more effective fracturing of the material passing beneath the bits 26 (see FIG. 2) on a conveyor, for example. The conveyor advances the material in the same direction to that in which the bits 26 are advanced by rotation of the rings 12.

While the edge 38 of each of the inserts 33 is preferably in the same plane as the plane of the substantially flat surface 16 of the ring 12 having the insert 33 disposed therein, it should be understood that such is not necessary for satisfactory operation. It is only necessary that the edge 38 of the insert 33 be either in the plane of the substantially flat surface 16 of the ring 12 or project therebeyond to insure that the edge 38 of the insert 33 strikes the aggregate material during rotation of the ring 12.

While the ring 12 has been shown as having the portions of its periphery between the cut out portions 15 formed by the substantially flat surfaces 16, it should be understood that such is not necessary for satisfactory operation. These portions of the periphery of the ring 12 could be arcuate rather than straight, if desired, but would still be flat. However, it is necessary that the edge 38 of the insert 33 be in the same plane or project beyond such an arcuate surface forming a portion of the periphery of the ring 12 and having the insert 33.

An advantage of this invention is that is reduces the horsepower required for a material fracturing device. Another advantage of this invention is that it prevents crushing of the material.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. A device for fracturing an aggregate type of material including:

a ring rotatable relative to the material to be fractured;

said ring having a plurality of angularly spaced bits mounted thereon around its periphery for contacting the material when said ring is rotated relative to the material to fracture the material;

said ring having a bit holder for each of said bits;

said ring having a plurality of cut out portions in its periphery, each of said cut out portions having one of said bit holders disposed therein;

said ring having fracturing means between each adjacent pair of said bits to aid in fracturing the material during rotation of said ring;

said ring having a recess in its periphery between each adjacent pair of said bits;

each of said fracturing means including an insert disposed in one of said recesses in said ring and secured to said ring;

and each of said inserts including material engaging means to fracture the material.

2. The device according to claim 1 including means to prevent each of said inserts from ripping out of said recess in which said insert is disposed.

3. The device according to claim 2 in which:

said material engaging means of each of said inserts is an angled edge of said insert for engaging the material to be fractured;

and said angled edge of said insert is disposed so that no portion of the periphery of said ring between the adjacent pair of said bit holders projects beyond said angled edge of said insert.

4. The device according to claim 3 in which:

said ring has a substantially flat surface forming its periphery between each adjacent pair of said cut out portions;

and said ring has one of said recesses in each of said substantially flat surfaces.

5. The device according to claim 4 in which said angled edge of each of said inserts has its outermost surface in substantially the same plane as said substantially flat surface having said recess for said insert.

6. The device according to claim 5 in which each of said recesses has one of its edges closer to one of the adjacent pair of said cut out portions than the other of its edges is to the other of the adjacent pair of said cut out portions.

7. The device according to claim 6 in which said recess has its trailing edge closer to the trailing one of the adjacent pair of said cut out portions than said recess has its leading edge to the leading one of the adjacent pair of said cut out portions.

8. The device according to claim 7 in which said ring has said bits equally angularly spaced from each other.

9. The device according to claim 1 in which:

said material engaging means of each of said inserts is an angled edge of said insert for engaging the material to be fractured;

and said angled edge of said insert is disposed so that no portion of the periphery of said ring between the adjacent pair of said bit holders projects beyond said angled edge of said insert.

10. A device for fracturing an aggregate type of material including:

a rotating shaft;

a plurality of rings mounted on said shaft for rotation therewith relative to the material to be fractured;

means to space said rings from each other axially along said shaft;

each of said rings having a plurality of angularly spaced bits mounted thereon around its periphery for contacting the material when said rings are rotated with said shaft relative to the material to fracture the material;

each of said rings having a bit holder for each of said bits;

each of said rings having a plurality of cut out portions in its periphery, each of said cut out portions having one of said bit holders disposed therein;

each of said rings having fracturing means between each adjacent pair of said bits to aid in fracturing the material during rotation of said shaft;

each of said rings having a recess in its periphery between each adjacent pair of said bits;

each of said fracturing means including an insert disposed in one of said recesses in each of said rings and secured to said ring;

and each of said inserts including material engaging means to fracture the material.

11. The device according to claim 10 including means to prevent each of said inserts from ripping out of said recess in which said insert is disposed.

12. The device according to claim 11 in which:

said material engaging means of each of said inserts is an angled edge of said insert for engaging the material to be fractured;

and said angled edge of said insert is disposed so that no portion of the periphery of said ring between the adjacent pair of said bit holders projects beyond said angled edge of said insert.

13. The device according to claim 12 in which:

each of said rings has a substantially flat surface forming its periphery between each adjacent pair of said cut out portions;

and each of said rings has one of said recesses in each of said substantially flat surfaces.

14. The device according to claim 13 in which said angled edge of each of said inserts has its outermost surface in substantially the same plane as said substantially flat surface having said recess for said insert.

15. The device according to claim 14 in which each of said recesses has one of its edges closer to one of the adjacent pair of said cut out portions than the other of its edges is to the other of the adjacent pair of said cut out portions.

16. The device according to claim 15 in which said recess has its trailing edge closer to the trailing one of the adjacent pair of said cut out portions than said recess has its leading edge to the leading one of the adjacent pair of said cut out portions.

17. The device according to claim 16 in which each of said rings has said bits equally angularly spaced from each other.

18. The device according to claim 10 in which:

said material engaging means of each of said inserts is an angled edge of said insert for engaging the material to be fractured;

and said angled edge of said insert is disposed so that no portion of the periphery of said ring between the adjacent pair of said bit holders projects beyond said angled edge of said insert.

* * * * *